United States Patent [19]

Artweger

[11] 4,201,497

[45] May 6, 1980

[54] APPARATUS FOR PRODUCING A WALL

[75] Inventor: Wolfgang Artweger, Windischgarsten, Austria

[73] Assignee: Artweger-Industrie-Gesellschaft m.b.H., Windischgarsten, Austria

[21] Appl. No.: 945,101

[22] Filed: Sep. 25, 1978

[30] Foreign Application Priority Data

Sep. 30, 1977 [AT] Austria ..... 6972/77

[51] Int. Cl.[2] ..... E01G 5/06

[52] U.S. Cl. ..... 405/150; 405/151

[58] Field of Search ..... 405/151, 152, 153, 154, 405/150, 132, 134, 146; 52/798, 592, 593

[56] References Cited

U.S. PATENT DOCUMENTS

| | | | |
|---|---|---|---|
| 2,264,100 | 11/1941 | Smith | 405/151 |
| 3,484,961 | 10/1976 | Chieger et al. | 52/593 |
| 3,583,123 | 6/1971 | Holmgren | 52/593 |
| 3,673,806 | 7/1972 | Hänig et al. | 405/153 |
| 3,710,581 | 1/1973 | Wong | 405/151 |

FOREIGN PATENT DOCUMENTS

| | | | |
|---|---|---|---|
| 181971 | 4/1936 | Switzerland | 52/798 |
| 781162 | 8/1957 | United Kingdom | 52/798 |

*Primary Examiner*—Dennis L. Taylor
*Attorney, Agent, or Firm*—Kurt Kelman

[57] ABSTRACT

A form for producing a wall, particularly for an underground gallery, comprises a plurality of support members spaced from each other and casing elements supported on the support members. Each casing element includes two casing plates spaced from each other and consisting of shape-retaining synthetic resin, end and side walls extending between the casing plates, and a set of substantially parallel webs of synthetic resin. The webs connect the casing plates to provide a shape-retaining support for the casing plates and to transmit between the plates stress and pressure forces to which the casing element is subjected.

10 Claims, 9 Drawing Figures

APPARATUS FOR PRODUCING A WALL

The present invention relates to improvements in apparatus for producing walls, particularly for erecting underground galleries with walls lining a shaft or tunnel or walls securing slopes. In the building of galleries, for example, such known apparatus comprises a plurality of support members spaced from each other and casing elements supported on the support members, each casing element including two spaced-apart casing plates.

Generally, conventional forms used for casting concrete walls or for like wall producing systems are comprised of wooden form parts. The use of wood is based on its relatively low cost and relatively good shape-retaining properties or rigidity in relation to its weight. Dismantling of the form frequently damages the form parts to such an extent that the parts are disposed after a single use. Where the form must encase walls of large areas, expensive tubular and metal parts are reqired to impart sufficient rigidity to the form to enable it to withstand the pressure forces emanating from the poured concrete hele encased by the form. While the form parts in such form systems may be a little lighter, more support members are needed per area unit of form so that the entire system is very heavy and quite expensive, making it economically necessary to re-use the parts as much as possible. This delays the erection of the forms and requires heavy lifting cranes for their emplacement.

Problems similar to those encountered in the erection of forms are present in building mine galleries, which term is understood herein to include all types of retaining walls for keeping open and securing mine shafts and tunnels. Various systems have been proposed for building such galleries economically and their parts are usually made of wood, steel or concrete. Galleries are usually built by erecting steel support structures, such as gallery frames, at predetermined distances along the shaft or tunnel and placing casing or retaining elements therebetween. Particularly in vaulted galleries, round timber is frequently used for the casing elements. When such round timber is used between the steel supports for encasing or retaining the mountain through which the tunnel has been dug, the encasement requires many parts. The assembly of such a system involves many difficulties and disadvantages.

To reduce labor, it has also been suggested to replace the round timber by sheet metal which, to increase its rigidity, may be corrugated. This makes it possible to use a single form part for retaining a wall. However, such sheet metal parts are very heavy and they are difficult to handle in the narrow confines of a mine gallery. Furthermore, under heavy pressures and other operating conditions, such sheet metal parts may be permanently deformed so that they must be straightened out in time-consuming and expensive restoring operations if they are to be re-used.

It has also been proposed to make the casing elements from flattened steel tubes. While such elements are more resistant to deformation under high pressures, they are much heavier than steel sheets.

It is the primary object of his invention to provide casing elements in apparatus of the first-described type which, while being lightweight, have sufficient shape retention or rigidity to withstand the stress and pressure forces to which the casing elements are subjected.

It is another object of the invention to provide such casing elements which are also capable of being easily handled even though they cover a large area.

The above and other objects are accomplished in accordance with the present invention with a casing element including two casing plates spaced from each other and consisting of shape-retaining synthetic resin, end and side walls extending between the two casing plates, and a set of substantially parallel webs of synthetic resin. The webs are substantially parallel to the end or side walls and connect the casing plates to provide a shape-retaining support for the casing plates and to transmit between the plates stress and pressure forces to which the casing element is subjected. The casing plates and their connecting webs move together.

This connection of the two casing plates by the webs and their manufacture of synthetic resin produces in an unexpectedly simple manner casing or retaining elements of high rigidity against bending and warping forces while being light in weight. The provision of the support webs spaced along the elements makes it possible for these elements to withstand high local stresses or pressures due to pouring concrete or like wall material. Structural synthetic resins have a high elastic deformation modulus so that any deformations in the elements due to relatively high stresses or pressures will remain within the elastic limit so that the elements may be readily reused. The high rigidity in connection with the high elasticity of the synthetic resin material, as well as its capacity for being readily shaped into various forms, furthermore make it possible to provide casing elements which may be assembled into leakproof and continuous walls so that the water required for the hardening of hydraulic concrete, for example, or water seeping from the mountainside will not escape through the assembled casing elements to inconveneience workers engaged in building the gallery.

The above and other objects, advantages and features of this invention will become ore apparent from the following detailed description of certain now preferred embodiments thereof, taken in conjunction with the accompanying drawing wherein FIG. 1 shows an axial section of a partial length of a one embodiment of an apparatus for producing a wall of a mine gallery;

Figures 1, 2, 3, 4, 5, 6, 7, 8, 9:
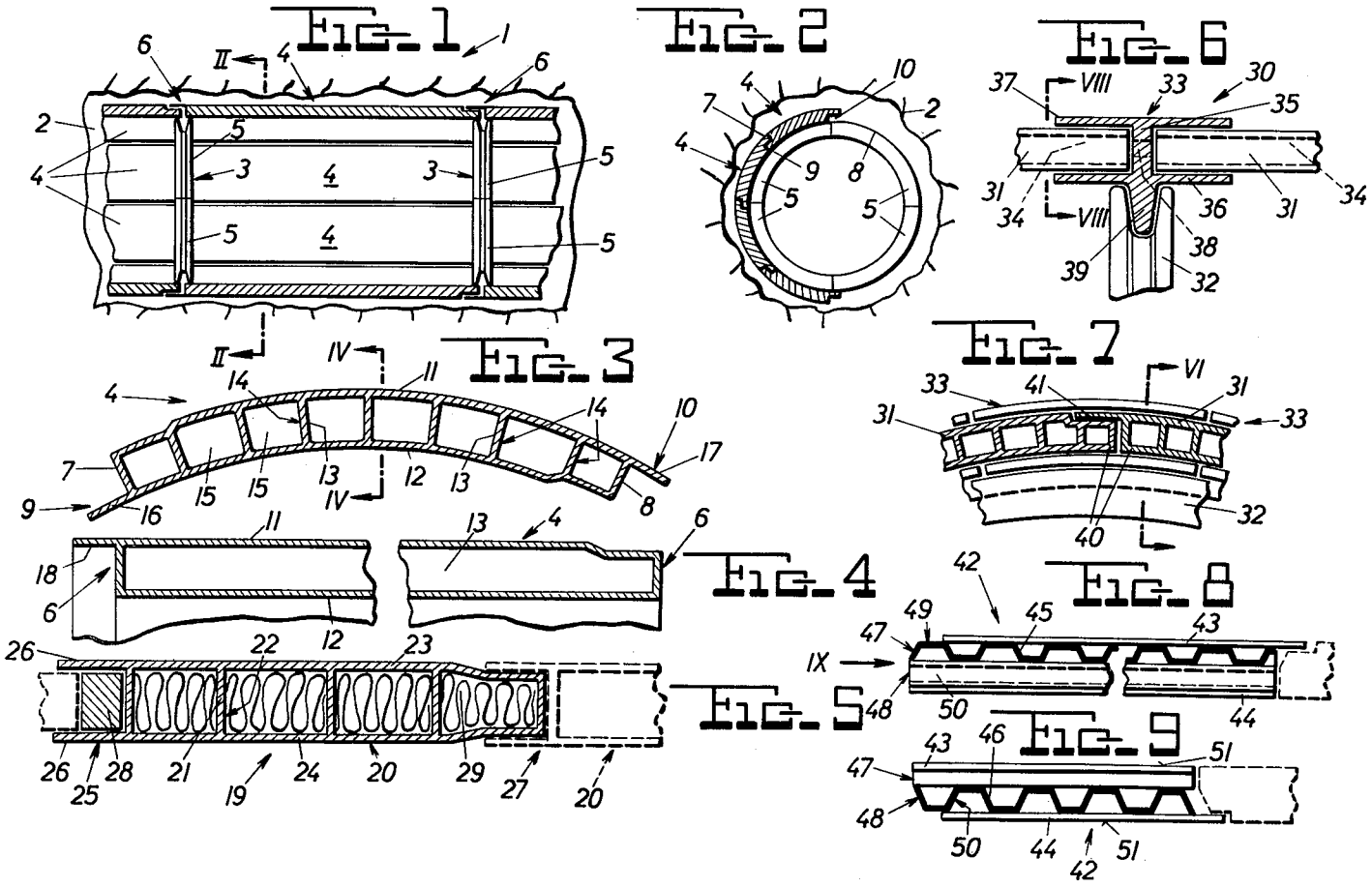
FIG. 2 is a transverse section along line II—II of FIG. 1.
FIG. 3 is an enlarged cross sectional view of one of the casing elements shown in FIGS. 1 and 2.
FIG. 4 is a section along line IV—IV of FIG. 3, showing the casing element in a view perpendicular to the one of FIG. 3.
FIG. 5 illustrates another embodiment of a casing element for erecting a form.
FIG. 6 illustrates a connection between casing elements of another embodiment, along line VI—VI of FIG. 7.
FIG. 7 shows the casing elements in a section along line VII—VII of FIG. 6.
FIG. 8 illustrates yet another embodiment of a casing element with two sets of connecting webs.
FIG. 9 is an end view of the casing element of FIG. 8, seen in the direction of arrow IX.

Referring now to the drawing and first to FIGS. 1 to 4, apparatus 1 for producing a wall, and more particularly for building mine gallery 2, is shown to comprise a plurality of support members 3 spaced from each other and casing or retaining elements 4 which include plates 11 and 12. Support members 3 are erected along the elongation of the gallery at predetermined distances, for example one meter, and they consist in the illustrated embodiment of arcuate segments 5 interconnected, for instance by threaded connections, to form a circular support, as shown in FIG. 2. Casing elements 4 extend between spaced support members 3 and retain the overhanging mountainside, the casing elements being supported on the support members at their end walls 6.

As can be seen in FIGS. 2 and 3, a leak-proof seal is provided between adjacent casing elements 4 by providing connecting flanges 9, 10 projecting beyond side walls 7 and 8, respectively. The illustrated connecting flanges are constituted by projecting portions of casing plates 11 and 12 spaced from each other, with end walls 6 and side walls 7, 8 extending between the casing plates. The connecting flanges overlap the adjacent end of an adjoining casing element and, as best seen in FIG. 3, fit into a recessed portion of the casing plate of the adjoining casing element.

Casing plates 11, 12 are connected not only by the end and side walls of the casing element but by a set of substantially parallel webs 13 which are substantially parallel to side walls 7, 8 and form support elements 14 for the casing plates. The webs connect the casing plates to provide a shape-retaining support for the casing plates and to transmit between the plates stress and pressure forces to which the casing element is subjected. In this way, the casing plates and their connecting support webs form an integral unit moving together.

The casing plates consist of shape-retaining synthetic resin, such as glass fiber-reinforced polystyrene, polycarbonate or polyamide and the webs also are of synthetic resin, which may be the same glass fiber-reinforced resin from which the casing plates are made or any other synthetic resin of sufficient rigidity to be capable transmitting the forces between the plates to which the casing element is subjected in use. The required connection between casing plates 11, 12 and webs 13 is obtained by providing the synthetic resin webs with rounded transition faces which are bonded to the casing plates by suitable adhesives, such as a synthetic resin which may contain a bonding agent, preferably under pressure. The bonding is carried out preferably in the "wet" state, i.e. while the synthetic resin of the casing plates has not yet fully hardened.

As appears from FIGS. 3 and 4, support webs 13 are arranged substantially parallel to side walls 7, 8 and perpendicular to end walls 6, the webs defining cavities 15 with the casing plates. Since the webs in this arrangement have a high resistance to pressure and stress or bending in the main direction of the loads to which the casing elements are subjected, a relatively small number of webs are capable of sustaining high loads without damage to the casing elements. Locally limited loads are distributed over a wider range because the support webs are in motion-transmitting connection with the casing plates so that local overloads or destruction of the casing elements will be avoided.

If desired, support webs 13 may also be made of a suitable synthetic resin foam, such as polyurethane foam of either an open- or closed-cell type. In this case, injection mold forms are inserted between casing plates 11 and 12, which in the illustrated example have a curvature conforming to the curvature of support members 3, and a polyurethane foam producing mixture is injected into the mold to form the webs. The polyurethane foam has the characteristic of forming an integral bond with the adjacent casing plate walls so that the desired connection between the casing plates and the support webs is automatically formed in the molding process. Thus, no special bonding or welding step is required for producing the required connection.

As has been indicated hereinabove, connecting flanges 9, 10 in the region of, and projecting from, side walls 7, 8 form connections between abutting casing elements which assure smooth walls for apparatus 1. For this purpose, these flanges are constituted by projecting portions 16, 17 of casing plates 12, 11 which are recessed at the side walls so as to receive the adjoining projecting portions. In this way, the inner and outer walls of apparatus 1, wherein the casing elements are assembled in abutting relationship, are smooth.

To obtain a tight connection between adjoining casing elements 4 in the direction of elongation of gallery 2, one of the casing plates of the elements has a flange 18 in the region of, and projecting from, one of end walls 6, as shown in FIG. 4. In the region of the opposite end wall 6, the same casing plate is suitably recessed to receive connecting flange 18 of the adjoining casing element.

Obviously, the connection between the adjoining casing elements is not limited to the illustrated formation of connecting flanges 9, 10 and 18, with their matching recesses, but may take any suitable form. If desired, for example, labyrinth gaskets or like seals may be provided at the abutments of the casing elements to provide more effective seals.

FIG. 5 shows another embodiment of the invention. Illustrated apparatus 19 for producing a wall, such as a concrete form, comprises casing or retaining elements 20 including two casing plates 23, 24 spaced from each other and a set of substantially parallel webs 21 forming support elements 22 connecting the plates. At one end 25 of casing element 20, each casing plate has a projecting portion 26 and the projecting plate portions define an open chamber therebetween for receiving the suitably constricted opposite end 27 of an abutting casing element, the casing plates being recessed at that end by the thickness of the projecting end position at end 25 so that the overlapping portions 26 form smooth inner and outer walls for apparatus 19.

If required, filling elements 28 may be arranged in the open chamber between projection casing plate portions 26 for proper positioning of the adjoining casing elements.

As shown in FIG. 5, the cavities defined by spaced webs 21 and casing plates 23, 24 are filled with synthetic resin foam 29. While all the cavities are shown filled with foam in the illustrated embodiment, only some of the cavities may be so filled, depending on the expected loads on apparatus 19. The provision of foam in the cavities enhances the rigidity of the apparatus and avoids possible damage to the casing elements by local impacts. In addition, such synthetic resin foam fillers provide thermal insulation.

If the webs are made of polyurethane foam, with its known quality of forming integral bonds with synthetic resin plates 23, 24 and the cavities between the webs are filled with foam, casing element 20 may be considered practically as an integral body without cavities, thus increasing the load-bearing capacity of the casing element and reducing the danger of damage by mechanical pressures, for instance under the load of loose rocks pressing in form the surrounding mountainside. It should also be noted that the foam fillings add only little weight to the apparatus.

In apparatus 30 shown in FIG. 6, sleeve-shaped connecting members 33 are associated with the ends of adjoining casing elements 31 for connecting the adjoining casing elements in the region of support members 32. In the illustrated embodiment, the adjoining casing elements define open chambers of cavities 34 at their ends extending into the connecting member 33 and the connecting member is comprised of plates 36, 37 interconnected by central web 35, the web defining bore 38 through which cavities 34 communicate. Such a connecting member provides a tight connection between adjoining casing elements. An advantageous support of connecting member 33 on support member 32 is provided by a guide part 39 projecting from bottom connecting member plate 36 into a conforming groove in support member 32.

As will be noted from a consideration of FIGS. 3 to 6, in all of these embodiments, the connection between adjoining casing elements is symmetrically arranged at their respective side and end walls, the connecting flanges on the casing plates or the special connecting member providing tight seals between the casing elements which prevent liquids from passing through the apparatus. By providing cavities in the casing elements, suitable operating conduits are made readily available, for instance for heating or cooling the surfaces of the apparatus and/or for ventilating a mine gallery. With the embodiment of FIG. 6, connecting member 33 provides a tight connection between cavities 34 in adjoining casing elements to assure a closed conduit system.

As shown in FIG. 7, casing elements 31 having connecting flanges 41 in the region of their side walls 40, connecting member plates 36, 37 and connecting flanges 41 all being arcuately shaped so as to conform to the curvature of support members 32. By using a series of connecting members 33 along the circumference of support member 32, a tight connection is provided between casing elements 31. Furthermore, the use of the connecting members increases the support area of the casing elements on support members 32 so that a deformation of the ends of the casing elements is avoided, thus making the elements available for frequent re-use.

FIGS. 8 and 9 illustrated a further embodiment comprising casing elements 42. Casing element 42 includes casing plates 43, 44 spaced from each other and two sets of webs connecting the casing plates to provide a shape-retaining support for the casing plates and to transmit between the plates stress and pressure forces to which the casing element is subjected. Each set is comprised of substantially parallel webs 47 and 48, the webs of one set being substantially perpendicular to those of the other set. The webs are plate elements 49, 50 which are corrugated. More particularly, the plate elements carry on one of their surfaces corrugations 45, 46, each protuberance of the corrugations being of trapezoidal cross section so that they corrugations extending perpendicular to each other interengage to form an interdigitating network, casing plates 43, 45 being offset from each other in the directions of both corrugations. This offset arrangement of the casing plates causes the surfaces of plate elements 49, 50 to be recessed with respect to the surfaces of casing plates 43, 44 in the region of the side and end walls of the casing element, as shown in FIGS. 8 and 9, so that the projecting portions of the casing plates overlap the adjoining casing elements shown in broken lines in these figures. This produces the tight and smooth connection described in connection with FIGS. 3 to 5.

Corrugated support webs connecting the casing plates have the advantage that they assist in absorbing not only the forces to which the casing elements are subjected in a vertical direction but also along the elongation of the casing elements. This makes the casing elements effective to sustain any load. The provision of support webs comprised of plate element having a flat surface in contact with the casing plate and a trapezoidal or like corrugation on the other surface provides a very good shape-retaining connection between the casing plates, assuring an even distribution of all forces over the casing element and a higher resistance against bending. Two such interdigitated sets of corrugated support webs provide a particularly useful casing element for concrete forms and like apparatus for producing walls.

For many uses, it will be most useful if the casing elements or at least their surfaces 51 are fire-retardant or -resistant.

As has been illustrated particularly in FIGS. 2 and 3, the casing elements are curved with respect to the side walls and the curvature of the casing elements conforms to the shape of supporting faces of the support members. This produces an effective support of the casing elements on the support members, reducing the danger of damage of the casing elements in use and increasing their capacability of sustaining stresses and pressures.

Obviously, the shape of the support webs and, when used, their corrugations may be modified in any desired manner, it being essential only that they provide a shape-retaining support for the casing plates and transmit between the plates stress and pressure forces to which the casing element is subjected so as to distribute all forces evenly.

What is claimed is:

1. An apparatus for producing a wall, which comprises (a) a plurality of support members spaced from each other and (b) like casing elements supported at respective ends thereof on the support members, at least the surfaces of the casing elements being fire-retardant and each one of the casing elements including (1) two casing plates spaced from each other and consisting of shape-retaining synthetic resin, (2) end and side walls extending between the two casing plates, (3) connecting flanges constituted by portions of the casing plates projecting beyond at least one of said walls, (4) a set of substantially parallel plate elements comprised of glass fiber reinforced synthetic resin or polyurethane foam, the plate elements being substantially parallel to at least one of the walls, the plate elements connecting the casing plates to provide a shape-retaining support for the casing plates and to transmit between the plates stress and pressure forces to which the casing element is subjected, and (5) the casing elements defining cavities defined by the casing plates and end walls, the cavities of adjacent ones of the casing elements being in communication for the formation of conduits.

2. The apparatus of claim 1, wherein the casing elements are arranged for support on the support members on the region of at least one of said walls, and the plate elements are arranged substantially perpendicularly to one of the walls.

3. The apparatus of claim 1, wherein the plate elements are arranged substantially parallel to the side walls and adjacent ones of the plate elements define cavities with the casing plates.

4. The apparatus of claim 1, wherein the plate elements are corrugated and the corrugations extend parallel to one of said walls.

5. The apparatus of claim 4, further comprising another set of said plate elements arranged substantially perpendicularly to the first-named plate elements, the sets of webs connecting the casing plates to provide the shape-retaining support and to transmit the forces.

6. The apparatus of claim 1, further cmprising sleeve-shaped connecting portions in the region of one of the walls of the casing elements for connecting adjacent ones of the casing elements.

7. The apparatus of claim 1, wherein the connecting flanges project beyond the side walls.

8. The apparatus of claim 1, further comprising sleeve-shaped connecting members associated with the ends of the casing elements for connecting adjacent ones of the casing elements.

9. The apparatus of claim 1, wherein the plate elements define cavities with the casing plates, and further comprising synthetic resin foam filling at least some of the cavities.

10. the apparatus of claim 1, wherein the casing elements are curved with respect to one of the walls and the curvature of the casing elements conforms to the shape of supporting faces of the support members.

* * * * *